US009181613B2

(12) United States Patent
Chida et al.

(10) Patent No.: US 9,181,613 B2
(45) Date of Patent: Nov. 10, 2015

(54) HIGH TENSILE STRENGTH HOT-DIP GALVANNEALED STEEL SHEET HAVING EXCELLENT COATED-LAYER ADHESIVENESS AND METHOD FOR PRODUCING SAME

(75) Inventors: Minoru Chida, Kakogawa (JP); Hiroshi Irie, Kakogawa (JP)

(73) Assignee: Kobe Steel, Ltd., Kobe-shi (JP)

( * ) Notice: Subject to any disclaimer, the term of this patent is extended or adjusted under 35 U.S.C. 154(b) by 0 days.

(21) Appl. No.: 14/111,819

(22) PCT Filed: Apr. 20, 2011

(86) PCT No.: PCT/JP2011/059716

§ 371 (c)(1),
(2), (4) Date: Oct. 15, 2013

(87) PCT Pub. No.: WO2012/144028

PCT Pub. Date: Oct. 26, 2012

(65) Prior Publication Data

US 2014/0030547 A1 Jan. 30, 2014

(51) Int. Cl.

| | |
|---|---|
| ***B32B 15/01*** | (2006.01) |
| ***C23C 2/06*** | (2006.01) |
| ***C23C 2/26*** | (2006.01) |
| ***C23C 2/28*** | (2006.01) |

(52) U.S. Cl.

CPC ... *C23C 2/06* (2013.01); *C23C 2/26* (2013.01); *C23C 2/28* (2013.01); *Y10T 428/12799* (2015.01)

(58) Field of Classification Search

None

See application file for complete search history.

(56) References Cited

U.S. PATENT DOCUMENTS

| | | | |
|---|---|---|---|
| 2006/0057417 | A1 | 3/2006 | Tada et al. |
| 2009/0025831 | A1 | 1/2009 | Yamamoto et al. |

FOREIGN PATENT DOCUMENTS

| | | | |
|---|---|---|---|
| JP | 6 81099 | | 3/1994 |
| JP | 2003-328099 | A | 11/2003 |
| JP | 2004-263295 | A | 9/2004 |
| JP | 2005 163164 | | 6/2005 |
| JP | 2006 283128 | | 10/2006 |
| JP | 2011 94215 | | 5/2011 |

OTHER PUBLICATIONS

International Search Report Issued Jul. 19, 2011 in PCT/JP11/059716 Filed Apr. 20, 2011.

Written Opinion of the International Searching Authority Issued Jul. 19, 2011 in PCT/JP11/059716 Filed Apr. 20, 2011.

*Primary Examiner* — Mark Ruthkosky

*Assistant Examiner* — Daniel J Schleis

(74) *Attorney, Agent, or Firm* — Oblon, McClelland, Maier & Neustadt, L.L.P.

(57) ABSTRACT

A high tensile strength hot-dip galvannealed steel sheet having excellent coated-layer adhesiveness in which the hot-dip galvannealed layer does not peel off from a base steel sheet even in being subjected to working accompanied by sliding and a method for producing the same are provided. In the high tensile strength hot-dip galvannealed steel sheet, a hot-dip galvannealed layer is formed on the surface of the base steel sheet, the base steel sheet contains Si by 0.04-2.5%, and, when the surface roughness of the base steel sheet after the hot-dip galvannealed layer is removed by dissolution with an acid is measured for a plurality of locations by a laser microscope, the arithmetic mean inclination angle (RΔa) is 23.0° or more and the root mean square inclination angle (RΔq) is 29.0° or more in 60% or more of all of the locations measured.

4 Claims, 1 Drawing Sheet

HIGH TENSILE STRENGTH HOT-DIP GALVANNEALED STEEL SHEET HAVING EXCELLENT COATED-LAYER ADHESIVENESS AND METHOD FOR PRODUCING SAME

TECHNICAL FIELD

The present invention relates to a high tensile strength hot-dip galvannealed steel sheet, and relates more specifically to a high tensile strength hot-dip galvannealed steel sheet having excellent coated-layer adhesiveness in which the hot-dip galvannealed layer does not peel off from the base steel sheet even in being subjected to working accompanied by sliding, and a method for producing the same.

BACKGROUND ART

For a structural member used for an automobile, from the viewpoint of improving safety and the viewpoint of vehicle body weight reduction for fuel consumption improvement as the measures for environment problems, high strengthening has been required. For such a structural member, improvement of corrosion resistance has also been required.

As a raw material having both of the strength and corrosion resistance, a hot-dip galvannealed steel sheet (may be hereinafter referred to as a GA steel sheet) is used which is obtained by subjecting the surface of a base steel sheet to hot-dip galvanizing and alloying the same. In order to exert the corrosion resistance, it is required for the GA steel sheet that there is not a non-coated portion, the surface appearance is excellent, and the hot-dip galvannealed layer does not peel off from the base steel sheet (may be hereinafter referred to as coated-layer adhesiveness).

As a technology for improving the adhesiveness of the interface between the hot-dip galvannealed layer and the base steel sheet of the GA steel sheet, Patent Literature 1 can be cited for example. In Patent Literature 1, it is described that the coated-layer adhesiveness can be improved by making the interface between the coated layer and the base steel sheet after alloying treatment is made a complex state in which unevenness is high and the coated layer and the base steel sheet are complicatedly arranged. More specifically, it is described to be effective to contain Si of a predetermined amount and to achieve a state of high surface roughness of 6.5 μm or more in terms of 10 point mean roughness Rz of the steel surface surface roughness after removing the hot-dip galvannealed layer.

Also, in Patent Literature 2, the present inventors have disclosed a technology for improving the slidability and powdering resistance of the GA steel sheet with the aim of improving the workability of the GA steel sheet. According to the technology, the slidability and powdering resistance of the GA steel sheet have been improved by properly controlling the containing balance of Mn, P, Cr, Mo out of the chemical composition of the high strength steel sheet.

On the other hand, the shape of the structural members described above is becoming complicated year by year, and the GA steel sheet may possibly be subjected to working accompanied by sliding. Therefore, provision of a GA steel sheet whose hot-dip galvannealed layer hardly peels off from the base steel sheet in sliding working has been desired.

CITATION LIST

Patent Literatures

[Patent Literature 1] Japanese Unexamined Patent Application Publication No. H6-81099

[Patent Literature 2] Japanese Unexamined Patent Application Publication No. 2006-283128

SUMMARY OF INVENTION

Technical Problems

The present invention has been developed in view of such circumstances as described above, and its object is to provide a high tensile strength hot-dip galvannealed steel sheet having excellent coated-layer adhesiveness in which the hot-dip galvannealed layer does not peel off from the base steel sheet even in being subjected to working accompanied by sliding, and a method for producing the same.

Solution to Problems

In the high tensile strength hot-dip galvannealed steel sheet in relation with the present invention, a hot-dip galvannealed layer is formed on the surface of a base steel sheet, the base steel sheet contains Si by 0.04-2.5% (means mass %; hereinafter the same with respect to chemical composition), and, when the surface roughness of the base steel sheet after the hot-dip galvannealed layer is removed by dissolution with an acid is measured for a plurality of locations by a laser microscope, the arithmetic mean inclination angle (RΔa) is 23.0° or more and the root mean square inclination angle (RΔq) is 29.0° or more in 60% or more of all of the locations measured.

The high tensile strength hot-dip galvannealed steel sheet can be produced by preparing a base steel sheet in which Si is contained by 0.04-2.5% and, when the surface roughness is measured by the laser microscope, the arithmetic mean inclination angle (RΔa) is 6.0° or more and the root mean square inclination angle (RΔq) is 12.0° or more in 60% or more of all of the locations measured, subjecting the base steel sheet to hot-dip galvanizing, and subsequently alloying the base steel sheet.

Advantageous Effects of Invention

In the high tensile strength hot-dip galvannealed steel sheet of the present invention, the hot-dip galvannealed layer hardly peels off from the base steel sheet even in being subjected to sliding working, because a predetermined amount of Si is contained in the base steel sheet and the arithmetic mean inclination angle (RΔa) and the root mean square inclination angle (RΔq) on the surface of the base steel sheet after the hot-dip galvannealed layer is removed are properly controlled, and the coated-layer adhesiveness becomes excellent.

DESCRIPTION OF EMBODIMENTS

Figure 1:
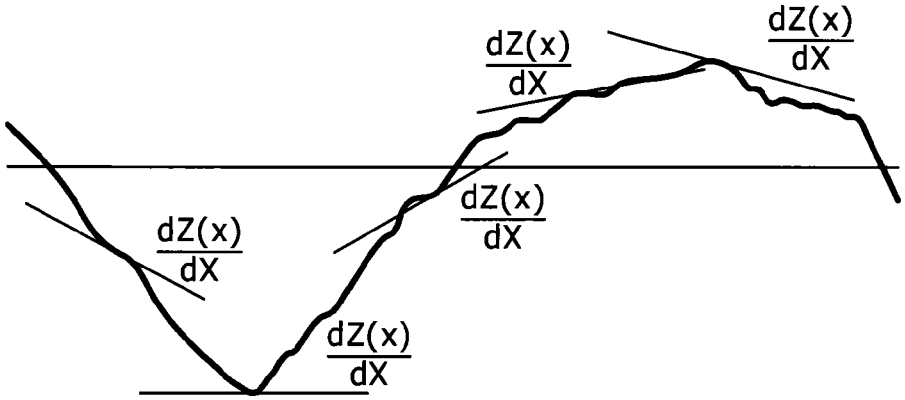
FIG. 1 is a drawing schematically showing a concept (local inclination dZ/dX) of a parameter (RΔa) used in the present invention for evaluating the coated-layer adhesiveness of the high tensile strength hot-dip galvannealed steel sheet.

The present inventors have made intensive studies in order to provide a high tensile strength hot-dip galvannealed steel sheet having excellent coated-layer adhesiveness in which the hot-dip galvannealed layer does not peel off from the base steel sheet even in being subjected to forming work particularly working accompanied by sliding, and a method for producing the same. As a result, followings have been found out and the present invention has been completed: (A) when a predetermined amount of Si is contained in the base steel sheet, the arithmetic mean inclination angle (RΔa) and the root mean square inclination angle (RΔq) on the surface of the base steel sheet after the hot-dip galvannealed layer is removed are used, and these are properly controlled instead of adopting the 10 point mean roughness Rz as an index of improvement of the coated-layer adhesiveness as described in Patent Literature 1 described above, the coated-layer adhesiveness of the high tensile strength hot-dip galvannealed steel sheet can be surely improved, and (B) such a high tensile strength hot-dip galvannealed steel sheet can be produced by subjecting the surface of the base steel sheet in which a predetermined amount of Si is contained and the arithmetic mean inclination angle (RΔa) and the root mean square inclination angle (RΔq) are properly controlled to hot-dip galvanizing, and alloying the same.

Below, (1) a high tensile strength hot-dip galvannealed steel sheet of the present invention will be described, and (2) a method for producing the high tensile strength hot-dip galvannealed steel sheet will be described thereafter.

[(1) On High Tensile Strength Hot-dip Galvannealed Steel Sheet]

Although the high tensile strength hot-dip galvannealed steel sheet of the present invention is obtained by forming the hot-dip galvannealed layer on the surface of the base steel sheet, it is characterized in that (a) the base steel sheet contains Si by 0.04-2.5%, and (b) when the surface roughness of the base steel sheet after the hot-dip galvannealed layer is removed by dissolution with an acid is measured for a plurality of locations by a laser microscope, the arithmetic mean inclination angle (RΔa) is 23.0° or more and the root mean square inclination angle (RΔq) is 29.0° or more in 60% or more of all of the locations measured.

Below, (a) the composition of the base steel sheet and (b) the arithmetic mean inclination angle (RΔa) and the root mean square inclination angle (RΔq) after the hot-dip galvannealed layer is removed by dissolution will be described separately.

«(a) On Composition of Base Steel Sheet»

The base steel sheet used in the present invention contains Si by 0.04-2.5%. This is because, when the present inventor studied, it was revealed that Si contained in the base steel sheet largely affected the surface roughness of the base steel sheet, particularly the arithmetic mean inclination angle (RΔa) and the root mean square inclination angle (RΔq). In order to properly control these requirements, in the present invention, Si is contained by 0.04% or more in the base steel sheet. The Si amount is preferably 0.06% or more, more preferably 0.08% or more, and further more preferably 0.1% or more. However, when the Si amount exceeds 2.5%, non-coating occurs and the surface appearance deteriorates. Therefore the Si amount is 2.5% or less, preferably 2% or less, and more preferably 1.5% or less. Also, as described below, when hot-dip galvanizing is executed by indirect heating, if Si of the surface of the base steel sheet increases, Si oxide is formed excessively, the surface appearance and coated-layer adhesiveness extremely deteriorate, and therefore the Si amount contained in the base steel sheet is preferably as less as possible. More specifically, the Si amount is preferably approximately 1% or less, more preferably 0.5% or less, further more preferably 0.25% or less, and still further more preferably 0.13% or less.

Other alloy elements contained in the base steel sheet are not particularly limited, and only have to be of a chemical composition normally used for the base steel sheet of the GA steel sheet. For example, a GA steel sheet satisfying the chemical composition disclosed in Patent Literature 2 previously proposed by the present inventors can be cited. The GA steel sheet contains C, Mn, P and Al as basic elements. For example, C: 0.06-0.15%, Mn: 1-3%, P: 0.01-0.05% and Al: 0.02-0.15% are contained as the basic elements. The GA steel sheet further contains selective elements such as Cr, Mo, Ti, Nb, V, B, Ca and the like. They are contained by the range of, for example, Cr: 0.03-1%, Mo: 0.03-1%, Ti: 0.15% or less (not including 0%), Nb: 0.15% or less (not including 0%), V: 0.15% or less (not including 0%), B: 0.01% or less (not including 0%), Ca: 0.01% or less (not including 0%).

The remainder can be iron and inevitable impurities. Among the impurities, S is preferably 0.03% or less (not including 0%). S forms sulfide-based inclusions in steel and causes deterioration of elongation and stretch flange formability.

«(b) On Arithmetic Mean Inclination Angle (RΔa) and Root Mean Square Inclination Angle (RΔq) of Base Steel Sheet After Hot-Dip Galvannealed Layer is Removed by Dissolution»

The high tensile strength hot-dip galvannealed steel sheet of the present invention is characterized in that the arithmetic mean inclination angle (RΔa) and the root mean square inclination angle (RΔq) of the base steel sheet after the hot-dip galvannealed layer is removed by dissolution with an acid are properly controlled. These surface property parameters have been employed in the present invention as the parameters capable of precisely evaluating the adhesiveness of the base steel sheet and the hot-dip galvannealed layer, and are very useful as the evaluation parameters particularly with respect to working accompanied by sliding. By using the surface property parameters, it became possible to precisely determine the level of the adhesiveness which could not be determined by the arithmetic mean roughness (Ra) generally employed (refer to examples described below).

Both of the arithmetic mean inclination angle (RΔa) and the root mean square inclination angle (RΔq) used in the present invention are the parameters that stipulate the inclination angle of a minute range (local inclination dZ/dX) formed by the surface unevenness with respect to a reference length X of the roughness curve. Out of them, RΔa expresses the arithmetic mean of the local inclination dZ/dX in the reference length and RΔq expresses the root mean square of the local inclination dZ/dX in the reference length respectively. In other words, RΔa and RΔq are in the relation of the average value (Ra) and the standard deviation (Δq) of the inclination angle in the minute range. For the reference purpose, the local inclination dZ/dX in the reference length is shown schematically in FIG. 1. The detail of the measurement method for them will be described below.

In the present invention, the arithmetic mean inclination angle (RΔa) and the root mean square inclination angle (RΔq) calculated by the method described below are required to satisfy 23.0° or more and 29.0° or more respectively. A greater value of them means a state that the inclination of the interface is more steep (precipitous state). More specifically, according to the result of the study by the present inventors, it was found out that control was necessary so that a wedge effect (anchor effect) caused by the inclination angle of the interface was properly exerted in order to surely secure excellent coated-layer adhesiveness with respect to working accompanied by sliding not to mention the case a compression force was applied to the coated layer such as V-bending and the like, and therefore the present invention has been completed.

Further, also in Patent Literature 1 described above, a technology is disclosed in which the adhesiveness of the hot-dip galvannealed layer with respect to the base steel sheet is improved by controlling the surface roughness (10 point mean roughness Rz here) of the base steel sheet after removing the hot-dip galvannealed layer. However, it was revealed that the coated-layer adhesiveness could not be evaluated precisely and dispersion of the quality occurred with the 10 point mean roughness (Rz) disclosed in Patent Literature 1 and the arithmetic mean roughness (Ra) generally used as an index of the surface roughness. In other words, as was proved by the examples described below, it was known that there was a case the levels of the coated-layer adhesiveness after sliding working were different from each other even when the arithmetic mean roughness (Ra) was controlled to a same degree and the degree of the adhesiveness could not be determined precisely. Further, according to the result of the study by the present inventors, it was also revealed that there was not necessarily high correlation between the depth between the peak and valley of the interface unevenness part such as the 10 point mean roughness (Rz) and the coated-layer adhesiveness after sliding working.

The reason the coated-layer adhesiveness after sliding working can be evaluated precisely by "RΔa" and "RΔq" used in the present invention not by Ra and Rz conventionally used is not known in detail, however, following reasoning would be possible.

As is standardized in JIS, the surface roughness parameter such as Ra (arithmetic mean roughness) and Rz (10 point mean roughness) is measured using a "contact type" surface roughness measuring instrument that detects the surface roughness by directly touching the surface of a sample by the tip of a stylus. Also in Patent Literature 1 described above, Rz of the base steel sheet surface after removing the hot-dip galvannealed layer is measured using a contact type surface roughness measuring instrument. The conventional method of measuring the surface roughness using a contact type surface roughness measuring instrument bears a problem that an unevenness shape of the surface cannot be evaluated correctly because of reasons such as abrasion of the stylus, an indentation to the sample surface by a measurement force, incapability of measurement of a groove smaller than the tip radius of the stylus, and the like.

On the other hand, because the arithmetic mean inclination angle (RΔa) and the root mean square inclination angle (RΔq) are measured using a non-contact type laser microscope in the present invention, minuter unevenness can also be measured precisely compared to the contact type described above, and the accuracy of the measurement result improves. In the present invention in particular, because the coated-layer adhesiveness after sliding working is allowed to be precisely evaluated by properly controlling the measuring condition of RΔa and RΔq instead of Ra and Rz which are bound by the measuring condition stipulated in JIS, correlation with the coated-layer adhesiveness can be improved remarkably.

The arithmetic mean inclination angle (RΔa) is 23.0° or more, and the root mean square inclination angle (RΔq) is 29.0° or more. When RΔa is less than 23.0° or RΔq is less than 29.0°, the anchor effect of the base steel sheet and the coated layer after sliding working cannot be exerted sufficiently, and the coated-layer adhesiveness deteriorates.

The arithmetic mean inclination angle (RΔa) and the root mean square inclination angle (RΔq) only have to satisfy the range described above in 60% or more of all of the locations measured. When the locations where RΔa is 23.0° or more are less than 60% and/or the locations where RΔq is 29.0° or more are less than 60% with respect to all of the locations measured, the anchor effect cannot be exerted sufficiently, and the coated-layer adhesiveness deteriorates. In order to improve the coated-layer adhesiveness, RΔa is preferably as large as possible, and is preferably 25.0° or more in 60% or more of all of the locations measured. Similarly, RΔq is also preferably as large as possible, and is preferably 31.0° or more in 60% or more of all of the locations measured. Also, the upper limit of RΔa is approximately 34° for example. Similarly, the upper limit of RΔq is approximately 42° for example.

Next, a method for measuring the arithmetic mean inclination angle (RΔa) and the root mean square inclination angle (RΔq) will be described. These are calculated by measuring, by a laser microscope, the surface roughness of the base steel sheet after the hot-dip galvannealed layer is removed by dissolution with an acid.

First, although dissolution is executed with an acid, the reason of doing so is for removing the coated layer without damaging the properties of the interface of the base steel sheet and the hot-dip galvannealed layer. As the acid, HCl and the like can be used, and one obtained by diluting 36 mass % HCl by pure water of the same amount can be used for example. In the acid, an inhibitor (acid corrosion inhibiting agent) normally used with an object of removing a coated layer and the like may be contained. As the inhibitor, a cyclic compound and an unsaturated compound can be used. For example, an amine-based inhibiting agent can be used, and more specifically, cyclohexamethylenetetramine and the like can be used.

Next, the arithmetic mean inclination angle (RΔa) and the root mean square inclination angle (RΔq) are measured using a laser microscope. The measuring position of RΔa and RΔq is not particularly limited so long as it is the surface after the hot-dip galvannealed layer is removed by dissolution. Measuring is to be done at plural locations and the number of the measuring locations is to be at least 10 locations, and 12 locations or more are preferable. With respect to the RΔa and the RΔq, because the measurement error is comparatively large, it is preferably measured at as many positions as possible.

In the present invention, data analysis is executed using a color laser microscope (trade name: "VK-9710") made by Kabushiki-Kaisha Keyence (Keyence Corporation) as a laser microscope and using a shape analysis application (trade name: "VK-H1A1") made by Keyence Corporation. This is because the measurement result of the arithmetic mean inclination angle (RΔa) and the root mean square inclination angle (RΔq) is largely affected by the measuring instrument and measuring condition.

The detail of the measurement procedure is shown in the examples described below, the line roughness analysis is selected, and the analysis is executed at optional positions. The data analysis can be executed in either of the lateral direction and in the vertical direction with respect to the measured data. The data analysis is executed with cutoff value λs=0.25 μm, phase compensation type high-pass filter λc=0.08 mm, phase compensation type low-pass filter λf=none.

The high tensile strength hot-dip galvannealed steel sheet of the present invention is characterized in properly controlling the composition of the base steel sheet and the arithmetic mean inclination angle (RΔa) and the root mean square inclination angle (RΔq) in the surface after the hot-dip galvannealed layer is removed, and other requirements are not particularly limited. For example, the Fe amount contained in the compound formed in the interface of the hot-dip galvannealed layer and the base steel sheet and in the hot-dip galvannealed layer is not particularly limited.

«Compound Formed in Interface of Hot-Dip Galvannealed Layer and Base Steel Sheet»

It is preferable that a Γ phase is formed discontinuously in the interface of the hot-dip galvannealed layer and the base steel sheet. The Γ phase can be expressed by $Fe_3Zn_{10}$, and is a hard and brittle phase. Therefore, if the Γ phase is formed continuously in the interface, the Γ phase is broken when bending work is executed and stress is applied for example, and the hot-dip galvannealed layer easily peels off from the base steel sheet. Accordingly, it is preferable that the Γ phase is formed discontinuously.

«Fe Amount Contained in Hot-Dip Galvannealed Layer»

The Fe amount contained in the hot-dip galvannealed layer is preferably 7-13%. When the Fe amount is excessively low, uneven alloying is liable to occur, and the surface appearance may deteriorate. Therefore, the Fe amount is preferably 7% or more, more preferably 8% or more. However, when the Fe amount becomes excessively high, the coated-layer adhesiveness deteriorates because the F phase grows thick in the interface of the base steel sheet and the hot-dip galvannealed layer, and powdering is liable to occur when bending work is executed for example. Therefore, the Fe amount is preferably 13% or less, more preferably 11% or less.

The Fe amount contained in the hot-dip galvannealed layer can be measured by atomic absorption analysis of the solution formed when the hot-dip galvannealed layer is removed by dissolution.

[(2) On Method for Producing High Tensile Strength Hot-dip Galvannealed Steel Sheet]

Next, a method for producing the high tensile strength hot-dip galvannealed steel sheet of the present invention will be described.

The high tensile strength hot-dip galvannealed steel sheet can be produced by preparing a base steel sheet in which Si is contained by 0.04-2.5% and, when the surface roughness is measured by the laser microscope, the arithmetic mean inclination angle (RΔa) is 6.0° or more and the root mean square inclination angle (RΔq) is 12.0° or more in 60% or more of all of the locations measured, subjecting the base steel sheet to hot-dip galvanizing, and subsequently alloying the base steel sheet. The reason of such stipulation will be described next.

First, a base steel sheet satisfying the chemical composition described above is prepared. Here, the arithmetic mean inclination angle (RΔa) of the base steel sheet surface should be 6.0° or more, and the root mean square inclination angle (RΔq) should be 12.0° or more. This is because, if RΔa of the base steel sheet surface is less than 6.0° or RΔq of the base steel sheet surface is less than 12.0°, the properties of the interface of the base steel sheet and the hot-dip galvannealed layer are not properly controlled when the hot-dip galvannealing is applied, and the coated-layer adhesiveness deteriorates.

The arithmetic mean inclination angle (RΔa) and the root mean square inclination angle (RΔq) only have to satisfy the range described above in 60% or more of all of the locations measured. This is because, when the locations where RΔa is 6.0° or more are less than 60% and/or the locations where RΔq is 12.0° or more are less than 60% with respect to all of the locations measured, the anchor effect cannot be exerted sufficiently when the hot-dip galvannealed steel sheet is formed, and the coated-layer adhesiveness deteriorates. In order to improve the coated-layer adhesiveness, RΔa is preferably as large as possible, and is preferably 8.0° or more in 60% or more of all of the locations measured. Similarly, RΔq is also preferably as large as possible, and is preferably 14.0° or more in 60% or more of all of the locations measured. Also, the upper limit of RΔa is not particularly limited from the viewpoint of improving the coated-layer adhesiveness, however, it is approximately 25° for example. Similarly, the upper limit of RΔq is approximately 33° for example.

The base steel sheet satisfying such surface properties can be obtained by using a steel sheet containing Si by a predetermined amount, holding HCl of 4-13 wt % content at 85±5° C. in a pickling step after hot rolling, immersing the steel sheet therein for 80-150 s, and thereafter making the sheet thickness after rolling the sheet thickness of 98% or less with respect to the sheet thickness before the final stand using a work roll with 2-5 μm roll surface roughness in terms of Ra in the final roll stand in the cold rolling step. When the HCl content is less than 4 wt %, the scale cannot be removed sufficiently, whereas when the HCl content exceeds 13 wt %, over-pickling occurs and the grain boundary of the surface layer of the steel sheet is corroded which becomes a cause of exerting an adverse effect on the coated-layer adhesiveness after coating. It is also similar with respect to the temperature of HCl and the immersion time. The HCl content is preferably 6-11 wt %, the temperature is 85±2° C., and the immersion time is 100-130 s. When the roughness of the work roll is less than 2 in terms of Ra, transcription of the roughness to the steel sheet is not sufficient, and a predetermined inclination angle cannot be secured. When Ra exceeds 5, the appearance quality after coating, or the sharpness after painting in particular, is adversely affected, and therefore the work roll cannot be applied. With respect to the draft before and after the final stand work roll, when the sheet thickness variation is less than 98%, sufficient transcription cannot be effected to the steel sheet surface, and predetermined inclination angle cannot be secured. The variation amount of the sheet thickness as far as approximately 90% is possible from the safety of the facilities.

Also, the arithmetic mean inclination angle (RΔa) and the root mean square inclination angle (RΔq) of the base steel sheet after the hot-dip galvannealed layer in the high tensile strength hot-dip galvannealed steel sheet is removed by dissolution with an acid are relatively larger than the arithmetic mean inclination angle (RΔa) and the root mean square inclination angle (RΔq) of the original sheet (base steel sheet) prepared for hot-dip galvannealing. This is because Fe is diffused to the surface side of the base steel sheet along with alloying, and that Zn intrudes to the grain boundary of the base steel sheet in alloying by an action of Si contained in the base steel sheet and changes the surface properties of the base steel sheet.

A method for subjecting the base steel sheet prepared to heat treatment, executing hot-dip galvannealing and alloying it is not particularly limited, and generally known conditions can be employed.

First, the base steel sheet is subjected to pickling to clean the surface of the base steel sheet according to the necessity, and heat treatment is thereafter executed by a continuous hot-dip galvanizing line. This heat treatment can be executed by a continuous hot-dip galvanizing line having an all radiant tube type annealing furnace for example, and the atmosphere inside the furnace can be a reductive atmosphere ($N_2$ gas atmosphere containing $H_2$ gas by 5-10 vol % for example). In the annealing furnace, the base steel sheet can be heated to 800-900° C., and the dew point inside the furnace can be made −45° C. or below for example. The lower limit of the dew point is approximately −60° C. because of the restriction of the facility.

Also, the base steel sheet may be subjected to heat treatment by an oxidation-reduction method instead of using the all radiant tube type annealing furnace. When Si that is an easily oxidizable element is contained by a comparatively large amount (exceeding 0.15% for example), heat treatment by the oxidation-reduction method is recommended, whereas when Si is contained by a comparatively small amount (0.15% or less for example), heat treatment by indirect heating with the all radiant tube type annealing furnace for example is recommended.

After the heat treatment, galvanizing treatment is executed. The galvanizing bath temperature can be approximately 440-480° C. The composition of the galvanizing bath is not also particularly limited, and generally known hot-dip galvanizing bath can be used. The Al content in the galvanizing bath is preferably 0.08-0.12% for example. Al acts effectively in controlling the alloying rate of the hot-dip galvanizing layer.

The steel sheet having been subjected to hot-dip galvanizing is further subjected to alloying treatment. The alloying treatment can be executed at approximately 500-560° C. When the alloying temperature is excessively low, uneven alloying is liable to occur, whereas when the alloying temperature is excessively high, alloying is excessively promoted and the Fe amount contained in the hot-dip galvannealed layer becomes excessively high. As a result, a Γ phase is formed in the interface of the hot-dip galvannealed layer and the base steel sheet, and the coated-layer adhesiveness deteriorates. The deposition amount of the hot-dip galvannealed layer is preferably approximately 30-70 g/m$^2$.

The alloying treatment can be executed using a heating furnace, direct firing, an infrared heating furnace and the like. The heating method is not also particularly limited, and a generally used means such as heating by gas and heating by an induction heater (heating by a high frequency induction heating apparatus) can be employed. Also, it is preferable to execute the alloying treatment immediately after the hot-dip galvanizing.

Because the high tensile strength hot-dip galvannealed steel sheet of the present invention is excellent in the coated-layer adhesiveness, even when working accompanied by sliding in particular is executed, peel off of the hot-dip galvannealed layer from the base steel sheet does not occur.

Although not particularly limited, the strength class of the high tensile strength hot-dip galvannealed steel sheet of the present invention can be a steel sheet with the tensile strength of the 980 MPa (100 kg) class for example.

EXAMPLES

Below, the present invention will be described more specifically referring to examples, however, the present invention is not limited by the examples described below, it is a matter of course that the present invention can also be implemented with modifications being added appropriately within a scope adaptable to the purposes described above and below, and any of them is to be included within the technical range of the present invention.

A hot rolled steel sheet was produced by melting steel containing C by 0.12%, Si by an amount shown in Table 1 below, Mn by 2.65%, P by 0.015% or less, S by 0.003% or less, Cr by 0.25%, Mo by 0.07% and Ti by 0.07% with the remainder being iron and inevitable impurities, and hot-rolling a slab obtained by casting the molten steel. Hot rolling was executed by rolling to 2.3 mm thickness with 860-900° C. finish-roll finishing temperature and winding at 530-590° C. The cold rolled sheet was produced by cold rolling after pickling the hot rolled steel sheet obtained. Cold rolling was executed to 1.4 mm thickness with 39% cold rolling ratio using a tandem mill type cold rolling mill (TCM). Here, only the work roll of the final stand of cold rolling was subjected to working for imparting roughness on the steel sheet surface. The sheet thickness variation (a rate of the outlet side sheet thickness relative to the inlet side sheet thickness) before and after the final stand is shown in Table 1.

The cold rolled sheet obtained was made the base steel sheet, the surface properties were examined by a laser microscope, and the arithmetic mean inclination angle (RΔa) and the root mean square inclination angle ($RA_q$) were measured.

With respect to the laser microscope, a color laser microscope (trade name: "VK-9710") made by Keyence Corporation was used. The surface properties were measured at optional positions of the base steel sheet. In measurement of the surface properties, the lens magnification was made 150, the monitor zoom was made 3 times, and data analysis was executed using the shape analysis application (trade name: "VK-H1A1") made by Keyence Corporation. With respect to the data analysis, the line roughness analysis was selected, and the measured data were analyzed at the positions of optional 12 points in the lateral direction. The line roughness analysis was executed for 23 μm×30 μm region of the field of observation. The analytical condition was: cutoff value λs=0.25 μm, phase compensation type high-pass filter λc=0.08 mm, phase compensation type low-pass filter λf=none, and the arithmetic mean inclination angle (RΔa) and the root mean square inclination angle (RΔq) were obtained. The result of measurement of RΔa and RΔq at the positions of 12 points is shown in Table 2. Also, the case RΔa was 6.0° or more and RΔq was 12.0° or more was made passing, the rate of the number of passing relative to all measurement number (12 points) (may be hereinafter referred to as an achievement rate) was calculated, and the result is shown in Table 2 below (for the convenience of explanation, the same result is also shown in Table 1).

Next, the base steel sheet obtained was heated to 815-845° C. in a real continuous type hot-dip galvanizing line having a vertical reduction annealing furnace of an all radiant tube type, was reduced with the dew point inside the furnace being the value shown in Table 1 below, and was thereafter immersed in the galvanizing bath to apply hot-dip galvanizing. The hot-dip galvanizing was executed with 0.105% of the effective Al amount in the galvanizing bath, and 460° C. of the galvanizing bath temperature. The high tensile strength hot-dip galvannealed steel sheet (GA steel sheet) was obtained by heating to 500-550° C. for alloying treatment after hot-dip galvanizing, and cooling thereafter to the room temperature. The deposition amount of the hot-dip galvannealed layer was 45-58 g/m$^2$. Also, the tensile strength of the high tensile strength hot-dip galvannealed steel sheet obtained was 985-1,080 MPa.

With respect to the high tensile strength hot-dip galvannealed steel sheet obtained, the hot-dip galvannealed layer was dissolved in an acid, and thereafter the Fe amount contained in the hot-dip galvannealed layer was measured by atomic absorption spectrochemical analysis of the solution. For dissolving of the hot-dip galvanizing layer, one obtained by adding cyclohexamethylenetetramine as an inhibitor by 3.5 g to 1 L of an acid that was obtained by diluting HCl of 36 mass % with the pure water of the same amount was used. The measurement result of the Fe amount contained in the hot-dip galvannealed layer is shown in Table 1 below.

Also, the surface properties of the base steel sheet after the hot-dip galvannealed layer was removed by dissolution with the acid as described above were examined by the laser microscope as described previously, and the arithmetic mean inclination angle (RΔa) and the root mean square inclination angle (RΔq) were measured. RΔa and RΔq were measured at positions of 12 points respectively, and the result of the measurement at the 12 points is shown in Table 3 below. Also, the case RΔa was 6.0° or more and RΔq was 12.0° or more was made passing, the rate of the number of passing relative to all measurement number (12 points) (achievement rate) was calculated, and the result is shown in Table 3 below (for the convenience of explanation, the same result is also shown in Table 1).

For reference purpose, the arithmetic mean roughness (Ra) after the hot-dip galvannealed layer was removed by dissolution with the acid was obtained. Ra was measured by a condition in accordance with JIS B 0601 (2001) with a contact type surface roughness measuring instrument ("SURFCOM 590A-3D-12 (trade name)" made by Kabushiki Kaisha Tokyo Seimitsu (Tokyo Seimitsu Co., Ltd.)) using a needle with the stylus tip diameter of 2 μm. The measurement result of Ra is shown in Table 1 below.

Also, the cross section of the high tensile strength hot-dip galvannealed steel sheet (the cross section in the thickness direction of the steel sheet) was observed by a scanning electron microscope (SEM) of 3,000 magnifications, and whether the Γ phase was formed or not in the interface of the base steel sheet and the hot-dip galvannealed layer was observed. As the result of the observation, it was recognized that the Γ phase was formed discontinuously when the Fe amount contained in the hot-dip galvannealed layer was 11% or less, whereas one the Γ phase was formed continuously was noticed when the Fe amount contained in the hot-dip galvannealed layer exceeded 11%.

Next, with respect to the high tensile strength hot-dip galvannealed steel sheet obtained, the coated-layer adhesiveness was evaluated by the following procedure.

<Evaluation of Coated-layer Adhesiveness>

Figure 2:
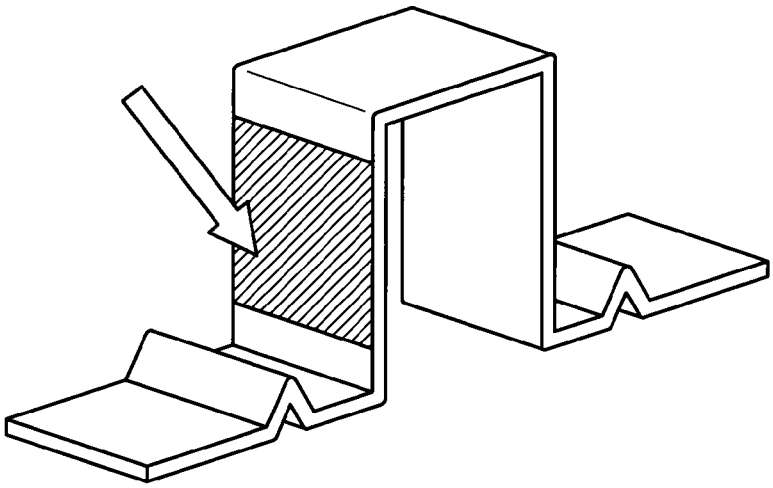
FIG. 2 is a schematic drawing showing the shape of a formed product manufactured for evaluating the coated-layer adhesiveness.

The coated-layer adhesiveness was evaluated by subjecting the high tensile strength hot-dip galvannealed steel sheet to U-bending with bead by the condition described below, visually observing the side wall outer side of the formed product, and measuring the coating peel off area. The shape of the formed product is shown in FIG. 2. In FIG. 2, the diagonal line portion pointed by an arrow is the side wall outer side (may be hereinafter referred to as a sliding section), and the area of the sliding section is approximately 30 $cm^2$. The evaluation criteria of the coated-layer adhesiveness are as described below. The evaluation result is shown in Table 1.

(Forming Condition)

Forming speed: 60 spm

Die shoulder radius: 2 mm

Punch shoulder radius: 5 mm

Bead tip radius: 2 mm

Bead height: 4 mm

Wrinkle pressing pressure: 0.17 MPa (1.6 $kgf/cm^2$)

(Evaluation Criteria)

◎ (passing): no peel off

○ (passing): occurrence of minute peel off of less than 1% of the sliding section Δ (failure): occurrence of peel off of 1% or more and less than 40% of the sliding section × (failure): occurrence of peel off of 40% or more of the sliding section Following study is possible from Table 1-Table 3.

Nos. 1-11 are the examples satisfying the requirement stipulated in the present invention, and are excellent in the coated-layer adhesiveness.

On the other hand, Nos. 12 and 13 are the examples not satisfying the requirement stipulated in the present invention.

In Nos. 12 and 13, the Si content is small. Furthermore, in Nos. 12 and 13, because the sheet thickness variation before and after the final stand that imparts roughness to the steel sheet surface is small (the rate of the outlet side sheet thickness relative to the inlet side sheet thickness is 98% or more), the hot-dip galvannealed layer is formed on the surface of the base steel sheet in which the arithmetic mean inclination angle (RΔa) and the root mean square inclination angle (RΔq) do not satisfy the requirement stipulated in the present invention. In these examples, because the arithmetic mean inclination angle (RΔa) and the root mean square inclination angle (RΔq) in the surface of the base steel sheet after the hot-dip galvannealed layer was removed by dissolving with an acid did not satisfy the requirement stipulated in the present invention, the coated-layer adhesiveness deteriorated.

Here, the relation between the arithmetic mean inclination angle (RΔa) and the root mean square inclination angle (RΔq) used as the indices in the present invention and the surface roughness (Ra) conventionally used as an index of the surface roughness will be studied. When Nos. 2 and 12, Nos. 10 and 13 are compared to each other respectively, the arithmetic mean roughnesses (Ra) in the base steel sheet surface after the hot-dip galvannealed layer is removed by dissolving with an acid are generally equal, however, Nos. 2 and 10 are excellent in the coated-layer adhesiveness whereas Nos. 12 and 13 are inferior in the coated-layer adhesiveness. Therefore, it is known that the level of the coated-layer adhesiveness cannot be evaluated precisely by the arithmetic mean roughness (Ra) that is the representative parameter of the surface roughness. On the other hand, it is known that the degree of the coated-layer adhesiveness that could not be discriminated by the arithmetic mean roughness (Ra) described above can be evaluated precisely when the arithmetic mean inclination angle (RΔa) and the root mean square inclination angle (RΔq) that are employed in the present invention as the evaluation parameters for the coated-layer adhesiveness are used.

From the above result, it is known that the coated-layer adhesiveness can be evaluated when the surface roughness of the base steel sheet after the hot-dip galvannealed layer is removed by dissolving with an acid is measured by a laser microscope and the arithmetic mean inclination angle (RΔa) and the root mean square inclination angle (RΔq) are measured.

TABLE 1

| No. | Base steel sheet: Si (mass %) | Base steel sheet: Achievement rate of 6.0° or more (%) of RΔa | Base steel sheet: Achievement rate of 12.0° or more (%) of RΔq | Dew point (° C.) | Fe amount in hot-dip galvannealed layer (mass %) | After removing hot-dip galvannealed layer: Achievement rate of 23.0° or more (%) of RΔa | After removing hot-dip galvannealed layer: Achievement rate of 29.0° or more (%) of RΔq | Coated-layer adhesive-ness | Arithmetic mean roughness Ra | Rate of outlet side sheet thickness relative to inlet side sheet thickness of TCM final stand (%) |
|---|---|---|---|---|---|---|---|---|---|---|
| 1 | 0.10 | 100 | 100 | −49.4 | 10.5 | 100 | 100 | ◎ | 0.184 | 92 |
| 2 | 0.13 | 100 | 100 | −49.4 | 9.4 | 100 | 100 | ◎ | 0.203 | 92 |
| 3 | 0.12 | 100 | 100 | −49.4 | 13.0 | 100 | 100 | ◎ | 0.145 | 93 |
| 4 | 0.06 | 100 | 100 | −47.0 | 7.1 | 75 | 83.3 | ◎ | 0.15 | 96 |
| 5 | 0.11 | 100 | 100 | −49.4 | 10.0 | 91.7 | 83.3 | ◎ | 0.174 | 95.5 |
| 6 | 0.12 | 100 | 100 | −49.4 | 9.4 | 100 | 91.7 | ◎ | 0.211 | 94 |
| 7 | 0.09 | 100 | 100 | −47.0 | 9.2 | 91.7 | 100 | ◎ | 0.145 | 96.5 |
| 8 | 0.15 | 100 | 100 | −49.4 | 8.1 | 91.7 | 66.7 | ◎ | 0.191 | 97 |
| 9 | 0.04 | 100 | 100 | −47.0 | 11.4 | 66.7 | 66.7 | ◎ | 0.186 | 97.5 |
| 10 | 0.05 | 100 | 100 | −47.0 | 7.8 | 66.7 | 75 | ◎ | 0.166 | 97 |
| 11 | 1.80 | 100 | 100 | −45.0 | 10.4 | 83.3 | 100 | ◎ | 0.211 | 95 |
| 12 | 0.03 | 41.7 | 41.7 | −47.0 | 10.2 | 50 | 66.7 | Δ | 0.200 | 98.5 |
| 13 | 0.02 | 25 | 33.3 | −47.0 | 10.1 | 16.7 | 33 | X | 0.167 | 99 |

TABLE 2

| No. | Kind | Base steel sheet: Inclination angle (deg.) Measuring line No. 1 | 2 | 3 | 4 | 5 | 6 | 7 | 8 | 9 | 10 | 11 | 12 | Achievement rate (%) |
|---|---|---|---|---|---|---|---|---|---|---|---|---|---|---|
| 1 | RΔa | 12.21 | 13.59 | 11.36 | 9.33 | 14.36 | 12.34 | 8.07 | 12.55 | 9.62 | 16.57 | 16.36 | 11.46 | 100 |
| | RΔq | 19.26 | 20.52 | 17.00 | 14.85 | 21.36 | 20.20 | 13.91 | 19.33 | 15.52 | 23.97 | 23.66 | 18.05 | 100 |
| 2 | RΔa | 7.75 | 10.42 | 10.72 | 9.02 | 11.40 | 13.72 | 11.39 | 12.08 | 8.40 | 10.46 | 9.74 | 10.50 | 100 |
| | RΔq | 14.62 | 17.62 | 17.45 | 15.25 | 18.94 | 19.97 | 16.58 | 18.06 | 14.35 | 18.53 | 16.82 | 18.63 | 100 |
| 3 | RΔa | 14.91 | 13.68 | 17.22 | 17.03 | 16.27 | 12.92 | 15.81 | 17.91 | 13.49 | 13.10 | 13.46 | 13.50 | 100 |
| | RΔq | 21.37 | 19.93 | 23.24 | 23.68 | 23.28 | 19.32 | 23.22 | 25.95 | 21.67 | 20.58 | 21.41 | 20.43 | 100 |
| 4 | RΔa | 13.09 | 14.29 | 13.13 | 14.67 | 13.19 | 14.68 | 16.09 | 13.63 | 19.77 | 16.79 | 16.62 | 17.71 | 100 |
| | RΔq | 18.99 | 20.69 | 18.66 | 22.09 | 20.08 | 21.70 | 25.21 | 20.90 | 28.35 | 24.56 | 24.04 | 25.11 | 100 |
| 5 | RΔa | 11.23 | 9.99 | 14.36 | 13.85 | 14.74 | 22.37 | 16.94 | 15.61 | 13.90 | 12.55 | 14.74 | 14.90 | 100 |
| | RΔq | 18.17 | 18.01 | 23.71 | 22.36 | 23.22 | 30.93 | 24.32 | 23.87 | 21.24 | 19.55 | 22.93 | 21.90 | 100 |
| 6 | RΔa | 21.87 | 19.66 | 14.67 | 18.28 | 20.18 | 12.69 | 16.78 | 13.65 | 15.67 | 18.43 | 15.11 | 16.84 | 100 |
| | RΔq | 29.06 | 28.49 | 21.65 | 26.53 | 28.49 | 18.45 | 23.60 | 20.45 | 24.05 | 25.93 | 22.62 | 25.28 | 100 |
| 7 | RΔa | 12.71 | 13.17 | 12.42 | 11.18 | 14.36 | 16.21 | 9.71 | 11.71 | 10.41 | 13.75 | 17.12 | 14.99 | 100 |
| | RΔq | 19.92 | 20.87 | 19.03 | 18.14 | 21.36 | 24.08 | 15.48 | 17.06 | 17.42 | 20.58 | 25.47 | 22.73 | 100 |
| 8 | RΔa | 16.19 | 14.01 | 18.21 | 14.93 | 14.82 | 12.25 | 16.04 | 17.06 | 11.81 | 12.07 | 14.24 | 14.04 | 100 |
| | RΔq | 22.93 | 20.07 | 24.91 | 21.39 | 21.93 | 18.77 | 22.51 | 25.57 | 18.77 | 19.88 | 22.53 | 21.08 | 100 |
| 9 | RΔa | 13.37 | 12.24 | 14.69 | 13.19 | 14.68 | 15.78 | 13.98 | 23.26 | 19.92 | 19.29 | 16.69 | 16.16 | 100 |
| | RΔq | 17.97 | 17.42 | 22.14 | 20.08 | 21.70 | 24.18 | 20.51 | 32.05 | 28.97 | 27.02 | 24.17 | 22.89 | 100 |
| 10 | RΔa | 20.43 | 19.39 | 16.10 | 18.57 | 17.62 | 15.20 | 17.39 | 15.69 | 13.96 | 17.54 | 17.38 | 14.05 | 100 |
| | RΔq | 27.42 | 27.05 | 23.81 | 26.46 | 25.44 | 21.63 | 24.29 | 22.76 | 20.94 | 24.54 | 25.97 | 22.39 | 100 |
| 11 | RΔa | 8.15 | 9.76 | 12.63 | 12.71 | 17.94 | 11.56 | 9.06 | 11.28 | 13.65 | 8.40 | 12.84 | 6.96 | 100 |
| | RΔq | 14.62 | 14.00 | 14.83 | 22.00 | 30.46 | 23.47 | 18.37 | 20.11 | 23.93 | 17.26 | 23.77 | 13.67 | 100 |
| 12 | RΔa | 6.15 | 6.04 | 4.60 | 4.18 | 6.20 | 6.50 | 3.94 | 3.22 | 4.92 | 3.15 | 5.40 | 7.00 | 41.7 |
| | RΔq | 13.66 | 12.69 | 10.49 | 9.28 | 15.14 | 12.54 | 8.57 | 6.90 | 11.91 | 5.09 | 10.96 | 12.90 | 41.7 |
| 13 | RΔa | 5.95 | 3.86 | 3.20 | 5.01 | 7.10 | 6.88 | 5.02 | 4.91 | 12.24 | 4.29 | 4.73 | 5.37 | 25 |
| | RΔq | 12.52 | 7.63 | 6.59 | 8.92 | 12.45 | 13.38 | 10.90 | 9.08 | 18.84 | 7.32 | 9.05 | 10.92 | 33.3 |

* RΔa: arithmetic mean inclination angle, RΔq: root mean square inclination angle

TABLE 3

| No. | Kind | After removing hot-dip galvannealed layer: Inclination angle (deg.) Measuring line No. 1 | 2 | 3 | 4 | 5 | 6 | 7 | 8 | 9 | 10 | 11 | 12 | Achievement rate (%) |
|---|---|---|---|---|---|---|---|---|---|---|---|---|---|---|
| 1 | RΔa | 26.88 | 29.43 | 26.47 | 30.07 | 27.68 | 23.75 | 28.32 | 25.89 | 27.23 | 24.62 | 27.71 | 28.74 | 100 |
| | RΔq | 34.03 | 37.12 | 33.25 | 37.89 | 35.31 | 31.93 | 36.36 | 33.01 | 34.65 | 32.00 | 34.91 | 36.15 | 100 |
| 2 | RΔa | 28.09 | 27.54 | 24.25 | 27.07 | 26.59 | 27.54 | 24.46 | 27.33 | 29.76 | 28.21 | 25.84 | 23.54 | 100 |
| | RΔq | 35.87 | 35.00 | 31.39 | 34.07 | 34.09 | 35.03 | 31.70 | 35.13 | 37.84 | 35.72 | 33.70 | 29.39 | 100 |

TABLE 3-continued

| | | « After removing hot-dip galvannealed layer » | | | | | | | | | | | | |
|---|---|---|---|---|---|---|---|---|---|---|---|---|---|---|
| | | Inclination angle (deg.) | | | | | | | | | | | | Achievement rate (%) |
| | | Measuring line No. | | | | | | | | | | | | |
| No. | Kind | 1 | 2 | 3 | 4 | 5 | 6 | 7 | 8 | 9 | 10 | 11 | 12 | |
| 3 | RΔa | 31.14 | 29.65 | 26.70 | 27.68 | 25.78 | 31.70 | 28.98 | 30.38 | 28.11 | 27.36 | 25.25 | 24.96 | 100 |
| | RΔq | 39.49 | 36.99 | 34.43 | 36.03 | 33.64 | 40.38 | 37.94 | 38.85 | 36.20 | 34.50 | 32.28 | 32.71 | 100 |
| 4 | RΔa | 22.30 | 26.28 | 22.77 | 24.57 | 26.12 | 30.96 | 20.45 | 24.93 | 25.39 | 25.16 | 25.06 | 24.12 | 75 |
| | RΔq | 28.01 | 33.88 | 29.94 | 31.99 | 33.42 | 38.03 | 28.21 | 32.50 | 32.46 | 32.57 | 31.99 | 31.06 | 83.3 |
| 5 | RΔa | 25.82 | 23.11 | 24.71 | 26.02 | 27.25 | 22.88 | 24.11 | 26.77 | 25.86 | 29.33 | 31.25 | 28.22 | 91.7 |
| | RΔq | 33.51 | 30.38 | 31.08 | 33.00 | 34.23 | 30.25 | 31.64 | 34.18 | 33.53 | 36.19 | 37.81 | 35.89 | 100 |
| 6 | RΔa | 29.47 | 29.57 | 29.74 | 33.07 | 32.28 | 26.97 | 23.43 | 30.51 | 26.33 | 30.03 | 26.91 | 23.88 | 100 |
| | RΔq | 36.74 | 37.24 | 38.03 | 41.32 | 39.77 | 34.76 | 28.78 | 38.46 | 33.59 | 37.68 | 35.66 | 31.14 | 91.7 |
| 7 | RΔa | 28.44 | 22.84 | 25.51 | 25.65 | 24.50 | 26.48 | 25.28 | 23.61 | 26.57 | 25.58 | 25.00 | 24.86 | 91.7 |
| | RΔq | 35.66 | 31.13 | 32.78 | 33.24 | 31.77 | 34.30 | 32.67 | 32.04 | 33.79 | 33.25 | 32.15 | 32.13 | 100 |
| 8 | RΔa | 30.69 | 29.78 | 26.22 | 25.97 | 26.47 | 25.76 | 25.52 | 24.37 | 23.96 | 23.59 | 22.31 | 24.85 | 91.7 |
| | RΔq | 38.23 | 36.21 | 32.99 | 33.36 | 33.11 | 33.93 | 32.75 | 28.51 | 28.44 | 28.43 | 28.91 | 32.38 | 66.7 |
| 9 | RΔa | 23.30 | 23.92 | 19.48 | 23.20 | 24.42 | 19.86 | 26.18 | 23.48 | 25.22 | 20.82 | 19.78 | 26.68 | 66.7 |
| | RΔq | 30.59 | 31.36 | 26.20 | 29.63 | 31.51 | 26.79 | 33.72 | 30.64 | 33.21 | 27.33 | 25.65 | 34.66 | 66.7 |
| 10 | RΔa | 27.38 | 28.51 | 24.21 | 28.12 | 19.84 | 21.56 | 25.42 | 21.38 | 25.48 | 23.16 | 22.50 | 25.41 | 66.7 |
| | RΔq | 34.02 | 35.94 | 31.32 | 35.50 | 26.18 | 28.30 | 32.58 | 28.08 | 32.22 | 29.97 | 29.15 | 32.41 | 75 |
| 11 | RΔa | 23.18 | 26.13 | 22.17 | 28.23 | 24.49 | 25.92 | 22.39 | 27.42 | 25.08 | 24.74 | 24.10 | 28.08 | 83.3 |
| | RΔq | 31.53 | 35.07 | 30.15 | 37.03 | 32.10 | 34.23 | 29.86 | 34.64 | 32.71 | 33.41 | 31.93 | 35.52 | 100 |
| 12 | RΔa | 29.74 | 26.63 | 24.55 | 20.96 | 24.04 | 23.92 | 21.96 | 22.16 | 24.18 | 21.09 | 21.23 | 21.39 | 50 |
| | RΔq | 36.72 | 34.29 | 31.01 | 29.30 | 31.26 | 30.76 | 28.42 | 29.61 | 31.05 | 27.93 | 28.08 | 28.23 | 66.7 |
| 13 | RΔa | 24.92 | 23.56 | 18.83 | 18.36 | 22.19 | 20.33 | 21.50 | 20.49 | 20.21 | 18.92 | 22.96 | 21.58 | 16.7 |
| | RΔq | 32.19 | 31.48 | 26.25 | 24.77 | 30.29 | 27.86 | 28.54 | 27.63 | 27.17 | 26.03 | 31.08 | 28.04 | 33.3 |

* RΔa: arithmetic mean inclination angle, RΔq: root mean square inclination angle

The invention claimed is:

1. A high tensile strength hot-dip galvannealed steel sheet having excellent coated-layer adhesiveness in which a hot-dip galvannealed layer is formed on the surface of a base steel sheet, wherein the base steel sheet contains Si by 0.04-2.5mass % and C by 0.06-0.15 mass %, and, when the surface roughness of the base steel sheet after the hot-dip galvannealed layer is removed by dissolution with an acid and is measured at a plurality of locations by a laser microscope, the arithmetic mean inclination angle (RΔa) is 23.0° or more and the root mean square inclination angle (RΔq) is 29.0° or more in 60% or more of all of the locations measured.

2. The high tensile strength hot-dip galvannealed steel sheet of claim 1, wherein the surface roughness results when the rate of outlet side sheet thickness relative to inlet side sheet thickness at the final stand of cold rolling is 98% or less after hot rolling and acid wash and before plating.

3. The high tensile strength hot-dip galvannealed steel sheet of claim 1, wherein the surface roughness results when the rate of outlet side sheet thickness relative to inlet side sheet thickness at the final stand of cold rolling is 97.5% to 92% after hot rolling and acid wash and before plating.

4. A method for producing the high tensile strength hot-dip galvannealed steel sheet having excellent coated-layer adhesiveness of claim 1, comprising the steps of:

preparing a base steel sheet in which Si is contained by 0.04-2.5 mass % and C is contained by 0.06-0.15 mass % and, when the surface roughness is measured by the laser microscope, the arithmetic mean inclination angle (RΔa) is 6.0° or more and the root mean square inclination angle (RΔq) is 12.0° or more in 60% or more of all of the locations measured;

subjecting the base steel sheet to hot-dip galvanizing; and subsequently alloying the base steel sheet.

* * * * *